US007670107B2

(12) United States Patent
Barthelet et al.

(10) Patent No.: US 7,670,107 B2
(45) Date of Patent: Mar. 2, 2010

(54) VARIABLE-VANE ASSEMBLY HAVING FIXED AXIAL-RADIAL GUIDES AND FIXED RADIAL-ONLY GUIDES FOR UNISON RING

(75) Inventors: Pierre Barthelet, Remiremont (FR); Olivier Espasa, Dogneville (FR); Eric Boucher, Rambervillers (FR); Francis Abel, Epinal (FR)

(73) Assignee: Honeywell International Inc., Morristown, NJ (US)

( * ) Notice: Subject to any disclaimer, the term of this patent is extended or adjusted under 35 U.S.C. 154(b) by 570 days.

(21) Appl. No.: 11/691,453

(22) Filed: Mar. 26, 2007

(65) Prior Publication Data

US 2008/0240906 A1 Oct. 2, 2008

(51) Int. Cl.
*F02D 23/00* (2006.01)

(52) U.S. Cl. ..... 415/160; 415/164; 415/165; 29/889.2

(58) Field of Classification Search ..... 415/160, 415/164, 165; 29/889.2
See application file for complete search history.

(56) References Cited

U.S. PATENT DOCUMENTS 4,679,984 A 7/1987 Swihart et al.
6,962,481 B2 11/2005 Knauer et al.
7,001,142 B2 2/2006 Knauer et al.
7,396,204 B2 * 7/2008 Shiraishi et al. ..... 415/160

FOREIGN PATENT DOCUMENTS

DE 10238412 A1 3/2004
DE 102004023210 A1 10/2005
DE 102004023209 12/2005
DE 102004023211 A1 12/2005

OTHER PUBLICATIONS

PCT/ISR PCT/US2008/057971.

* cited by examiner

*Primary Examiner*—Igor Kershteyn
(74) *Attorney, Agent, or Firm*—Alston & Bird

(57) ABSTRACT

A variable-vane assembly for a variable nozzle turbine comprises a nozzle ring supporting a plurality of vanes affixed to vane arms that are engaged in recesses in the inner edge of a unison ring. The unison ring is rotatable about the axis of the nozzle ring so as to pivot the vane arms, thereby pivoting the vanes in unison. A plurality of radial-axial guide pins for the unison ring are inserted into apertures in the nozzle ring and are rigidly affixed therein such that the radial-axial guide pins are non-rotatably secured to the nozzle ring with a guide portion of each radial-axial guide pin projecting axially from the face of the nozzle ring. Each guide portion defines a groove for receiving the inner edge of the unison ring such that the unison ring is restrained by the radial-axial guide pins against excessive movement in both radial and axial directions.

5 Claims, 12 Drawing Sheets

VARIABLE-VANE ASSEMBLY HAVING FIXED AXIAL-RADIAL GUIDES AND FIXED RADIAL-ONLY GUIDES FOR UNISON RING

BACKGROUND OF THE INVENTION

The present invention relates to turbochargers having a variable-nozzle turbine in which an array of movable vanes is disposed in the nozzle of the turbine for regulating exhaust gas flow into the turbine.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

One of the challenges in boosting engine performance with a turbocharger is achieving a desired amount of engine power output throughout the entire operating range of the engine. It has been found that this objective is often not readily attainable with a fixed-geometry turbocharger, and hence variable-geometry turbochargers have been developed with the objective of providing a greater degree of control over the amount of boost provided by the turbocharger. One type of variable-geometry turbocharger is the variable-nozzle turbocharger (VNT), which includes an array of variable vanes in the turbine nozzle. The vanes are pivotally mounted in the nozzle and are connected to a mechanism that enables the setting angles of the vanes to be varied. Changing the setting angles of the vanes has the effect of changing the effective flow area in the turbine nozzle, and thus the flow of exhaust gas to the turbine wheel can be regulated by controlling the vane positions. In this manner, the power output of the turbine can be regulated, which allows engine power output to be controlled to a greater extent than is generally possible with a fixed-geometry turbocharger.

Typically the variable-vane assembly includes a nozzle ring that rotatably supports the vanes adjacent one face of the nozzle ring. The vanes have axles that extend through bearing apertures in the nozzle ring, and vane arms are rigidly affixed to the ends of the axles projecting beyond the opposite face of the nozzle ring. Thus the vanes can be pivoted about the axes defined by the axles by pivoting the vane arms so as to change the setting angle of the vanes. In order to pivot the vanes in unison, an actuator ring or "unison ring" is disposed adjacent the opposite face of the nozzle ring and includes recesses in its radially inner edge for receiving free ends of the vane arms. Accordingly, rotation of the unison ring about the axis of the nozzle ring causes the vane arms to pivot and thus the vanes to change setting angle.

The variable-vane assembly thus is relatively complicated and presents a challenge in terms of assembly of the turbocharger. There is also a challenge in terms of how the unison ring is supported in the assembly such that it is restrained against excessive radial and axial movement while being free to rotate for adjusting the vane setting angle. Various schemes have been attempted for supporting unison rings, including the use of rotatable guide rollers supported by the nozzle ring. Such guide rollers complicate the assembly of the variable-vane assembly because by their very nature they can easily fall out of or otherwise become separated from the nozzle ring, since typically they fit loosely into apertures in the nozzle ring.

BRIEF SUMMARY OF THE DISCLOSURE

The present disclosure relates to a variable-vane assembly for a variable nozzle turbine such as used in a turbocharger, in which the unison ring is radially and axially located with non-rotating guides rigidly secured to the nozzle ring. In one embodiment, the variable-vane assembly comprises a nozzle ring encircling an axis and having an axial thickness defined between opposite first and second faces of the nozzle ring, the nozzle ring having a plurality of circumferentially spaced-apart first apertures each extending axially into the first face and a plurality of circumferentially spaced-apart second apertures that are circumferentially spaced from the first apertures and each of which extends axially from the first face to the second face. The assembly also includes a plurality of vanes each having an axle extending from one end thereof, the axles being received respectively into the second apertures from the second face of the nozzle ring and being rotatable in the second apertures such that the vanes are rotatable about respective axes defined by the axles, a distal end of each axle projecting out from the respective second aperture beyond the first face. A plurality of vane arms are respectively affixed rigidly to the distal ends of the axles, each vane arm having a free end. The setting angles of the vanes are changed in unison by a unison ring having a radially inner edge defining a plurality of recesses therein for respectively receiving the free ends of the vane arms when the unison ring is positioned coaxially with the nozzle ring adjacent the first face thereof. The unison ring is rotatable about the axis of the nozzle ring so as to pivot the vane arms, thereby pivoting the vanes in unison.

The assembly also comprises a plurality of radial-axial guide pins for the unison ring, the radial-axial guide pins each being inserted into a respective one of the first apertures in the nozzle ring and being rigidly affixed therein such that the radial-axial guide pins are non-rotatably secured to the nozzle ring with a guide portion of each radial-axial guide pin projecting axially from the first face of the nozzle ring. Each guide portion defines a groove in a radially outwardly facing outer surface for receiving the radially inner edge of the unison ring such that the unison ring is restrained by the radial-axial guide pins against excessive movement in both radial and axial directions.

In one embodiment, the nozzle ring defines a plurality of circumferentially spaced-apart third apertures extending into the first face. The third apertures are circumferentially spaced from the first and second apertures. The variable-vane assembly further includes a plurality of radial-only guide pins inserted respectively into the third apertures and rigidly affixed therein such that the radial-only guide pins are non-rotatably secured to the nozzle ring with a guide portion of each radial-only guide pin projecting axially from the first face of the nozzle ring. The guide portion of each radial-only guide pin has an outer surface contacting the radially inner edge of the unison ring such that the unison ring is restrained by the radial-only guide pins against excessive movement in the radial direction but not in the axial direction.

Assembly of the variable-vane assembly is facilitated by the provision of the radial-axial guide pins (and the radial-only guide pins, when present). More particularly, because the guide pins are fixedly secured to the nozzle ring, they cannot inadvertently fall out. Once the unison ring is engaged with the guide pins secured to the nozzle ring, the nozzle ring and unison ring cannot easily become separated, and the assembly can be turned upside down (unison ring facing down, nozzle ring facing up) without fear of the unison ring inadvertently falling off.

The guide pins can be secured to the nozzle ring by being press fit into the apertures in the nozzle ring, or by any other suitable technique.

In one embodiment, the radial-axial guide pins are configured and located and the recesses in the radially inner edge of the unison ring are configured and located such that in a first rotational position of the unison ring with respect to the nozzle ring each of the radial-axial guide pins is aligned with an associated one of the recesses in the inner edge of the unison ring, thereby allowing the unison ring to be slid axially past the radial-axial guide pins into proximity with the first face of the nozzle ring. The recesses in the unison ring for the vane arms provide the needed clearance to allow the unison ring to be slid past the radial-axial guide pins. The unison ring then is rotatable into a second rotational position with respect to the nozzle ring in which the radial-axial guide pins are misaligned with the recesses in the unison ring. This rotational movement causes the inner edge of the unison ring to engage the grooves in the radial-axial guide pins, such that the unison ring is captured by the radial-axial guide pins and prevented from being axially withdrawn from the nozzle ring.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
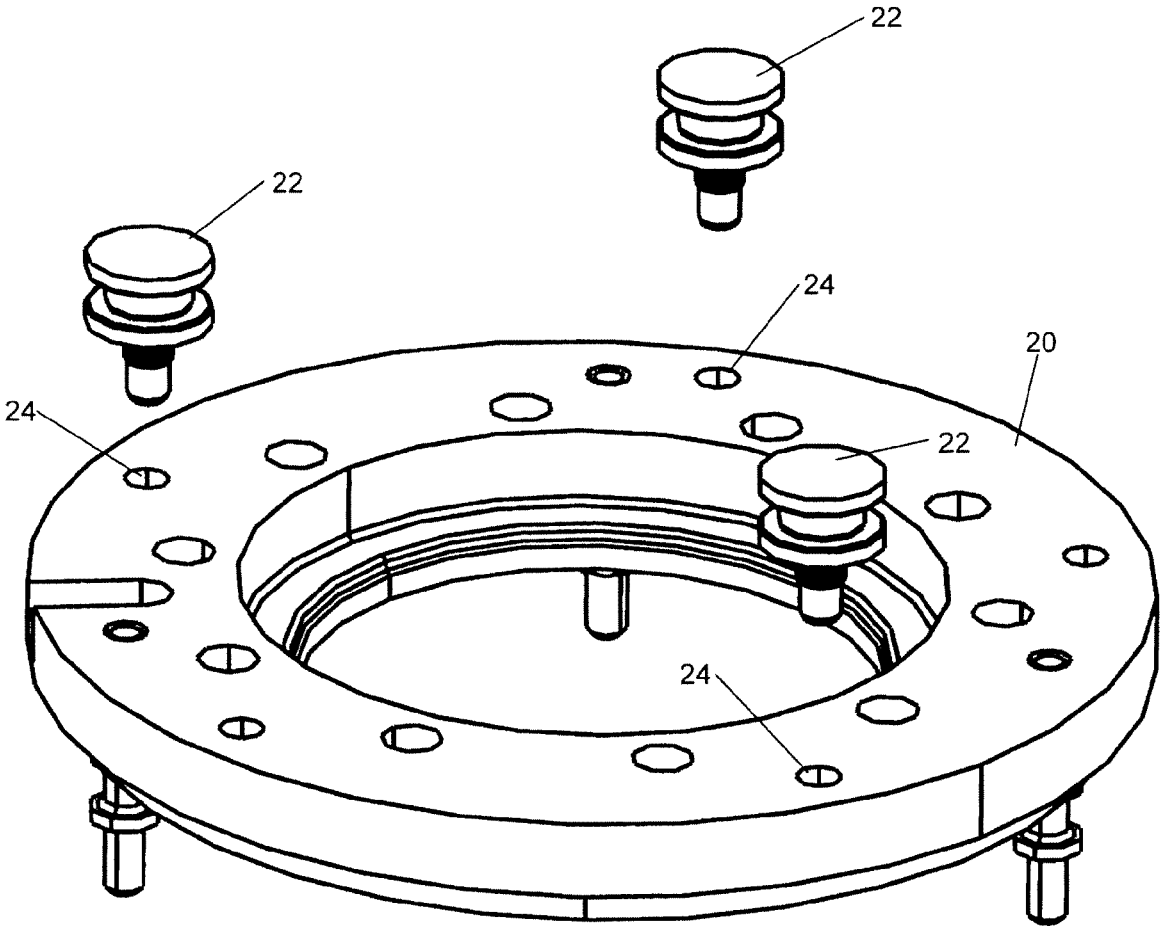
FIG. 1 is an exploded view of a nozzle ring and radial-axial guide pins in accordance with one embodiment of the invention.
Figure 2:
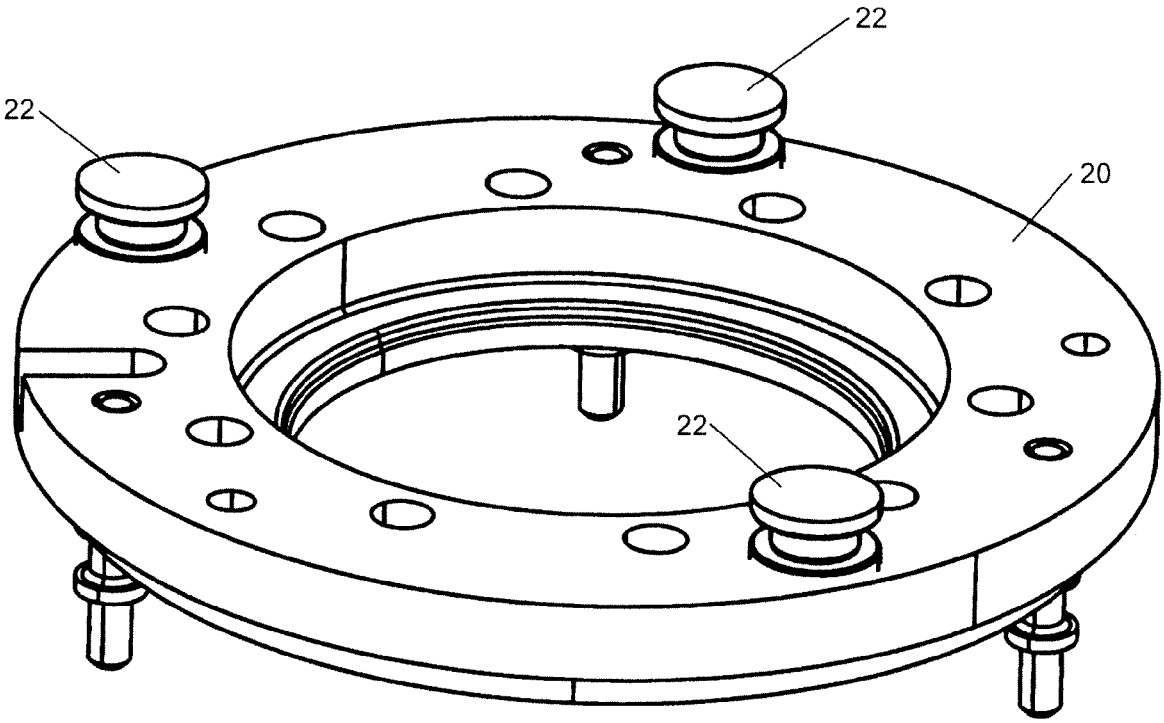
FIG. 2 is a perspective view showing the radial-axial guide pins fixedly secured in corresponding apertures in the first face of the nozzle ring.

FIG. 1 shows an exploded view of a nozzle ring 20 with a plurality of radial-axial guide pins 22. The nozzle ring has a plurality of circumferentially spaced first apertures 24 extending into a first face of the nozzle ring for receiving the radial-axial guide pins. More particularly, each radial-axial guide pin has a generally cylindrical pin portion of relatively small diameter that is sized to fit into a corresponding first aperture 24 with an interference fit, and has a guide portion of larger diameter that abuts the first face of the nozzle ring when the pin portion is fully inserted into a first aperture. The guide pins 22 are press-fit into the first apertures 24, such that the guide portions of the radial-axial guide pins project axially from the first face of the nozzle ring as shown in FIG. 2. In the illustrated embodiment, there are three radial-axial guide pins 22 spaced approximately uniformly about the circumference of the nozzle ring, although a different number of radial-axial guide pins could be used.

Figure 1A:
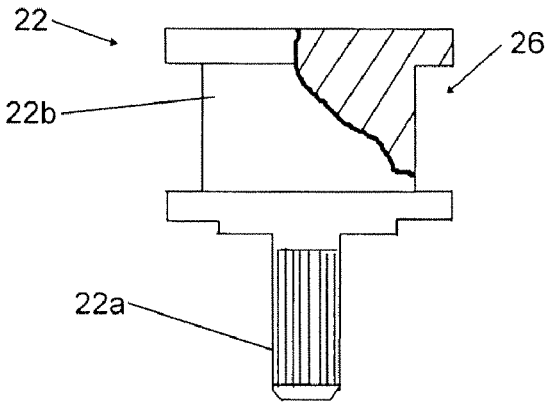
FIG. 1A is a side view, partly in section, of a guide pin in accordance with one embodiment of the invention.
Figure 1B:
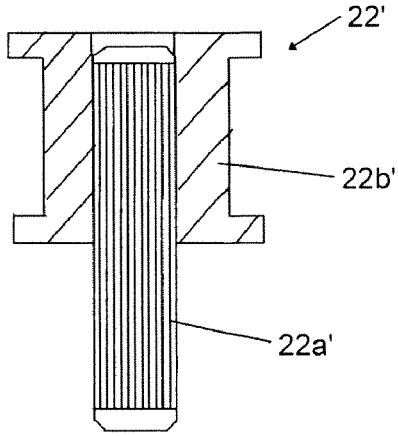
FIG. 1B is a side view, partly in section, of a guide pin in accordance with another embodiment.
Figure 1C:
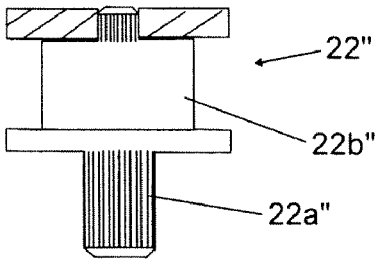
FIG. 1C is a side view, partly in section, of a guide pin in accordance with yet another embodiment.

FIGS. 1A, 1B, and 1C depict three possible non-limiting embodiments of guide pins useful in the variable-vane assembly described herein. A one-piece guide pin 22 is shown in FIG. 1A. The pin portion 22*a* and the guide portion 22*b* comprise an integral one-piece member (e.g., forged or machined from a piece of bar stock or the like). The pin portion 22*a* advantageously has knurling as shown, which facilitates secure fastening of the pin portion by press-fitting into the aperture in the nozzle ring. The guide portion 22*b* defines a groove 26 that extends in a circumferential direction of the pin at least partially about the circumference of the guide portion. In the illustrated embodiment, the groove 26 extends fully about the circumference, but alternatively the groove can extend only partway about the circumference. The width of the groove 26 (i.e., the dimension of the groove in the direction parallel to the axis of the guide pin) is sufficiently large to receive the inner edge of the unison ring of the variable-vane assembly, as further described below.

An alternative guide pin structure is shown in FIG. 1B, which depicts a two-piece guide pin 22' formed by a knurled pin portion 22*a*' and a guide portion 22*b*'. The guide portion includes a central hole therethrough and a part of the length of the pin portion is press-fit into the hole, the remaining length projecting out from the hole for press-fitting into the aperture in the nozzle ring. The guide portion and pin portion can be joined together either prior to or after press-fitting of the pin portion in the aperture of the nozzle ring. The two parts of the guide pin are fixedly joined such that they do not rotate relative to each other.

FIG. 1C shows another alternative two-piece guide pin structure. The guide pin 22" has a pin portion 22*a*" formed integrally with a part of the guide portion 22*b*". The guide portion is formed in two separate parts. More particularly, one of the "flanges" of the guide portion and the reduced-diameter part of the guide portion are formed integrally with the pin portion 22*a*", and a knurled end of this structure opposite from the pin portion is press-fit into a hole in the other "flange" of the guide portion. This second flange can be joined to the rest of the guide pin either prior to or after press-fitting of the pin portion in the aperture of the nozzle ring.

Figure 3:
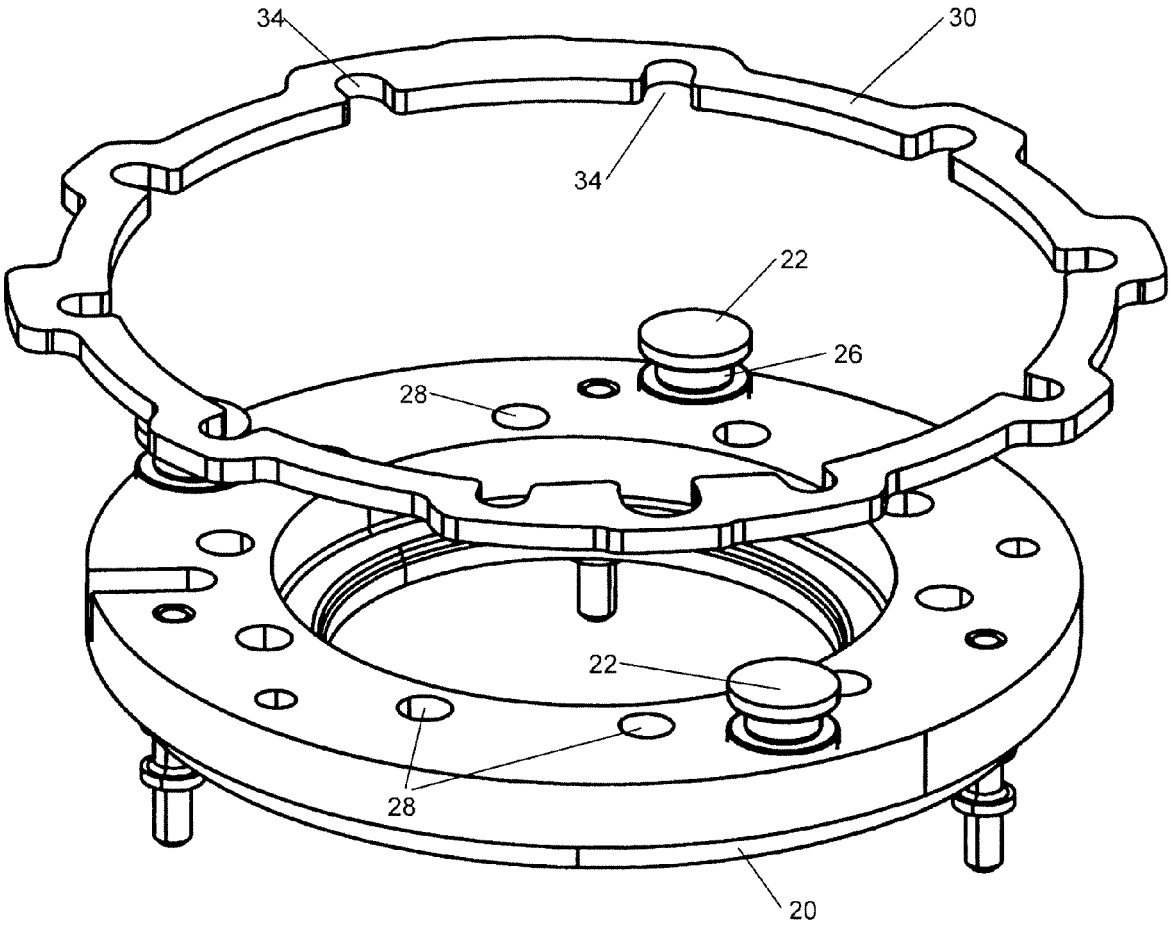
FIG. 3 is an exploded view of the nozzle ring and the unison ring.

FIG. 3 shows the assembly of FIG. 2 together with a unison ring 30. The unison ring has a radially inner edge 32 that is smaller in diameter than the maximum diameter defined collectively by the flanges of the guide portions of the radial-axial guide pins 22. If the grooves 26 in the guide portions extend only partway about the circumference, the pins are mounted such that the grooves face radially outwardly toward the inner edge of the unison ring. The largest diameter collectively defined by the bottom walls of the grooves 26 is very slightly smaller than or about equal to the diameter of the inner edge 32 of the unison ring 30. Accordingly, it is possible for the unison ring to be assembled with the radial-axial guide pins such that the inner edge 32 of the unison ring is engaged in the grooves 26 of the guide pins, and the flanges on opposite sides of each groove 26 restrain the unison ring against axial movement, while the bottom walls of the grooves 26 restrain the unison ring against radial movement relative to the nozzle ring. However, the challenge is how to assemble the unison ring with the guide pins and nozzle ring in the most expedient manner.

Figure 4:
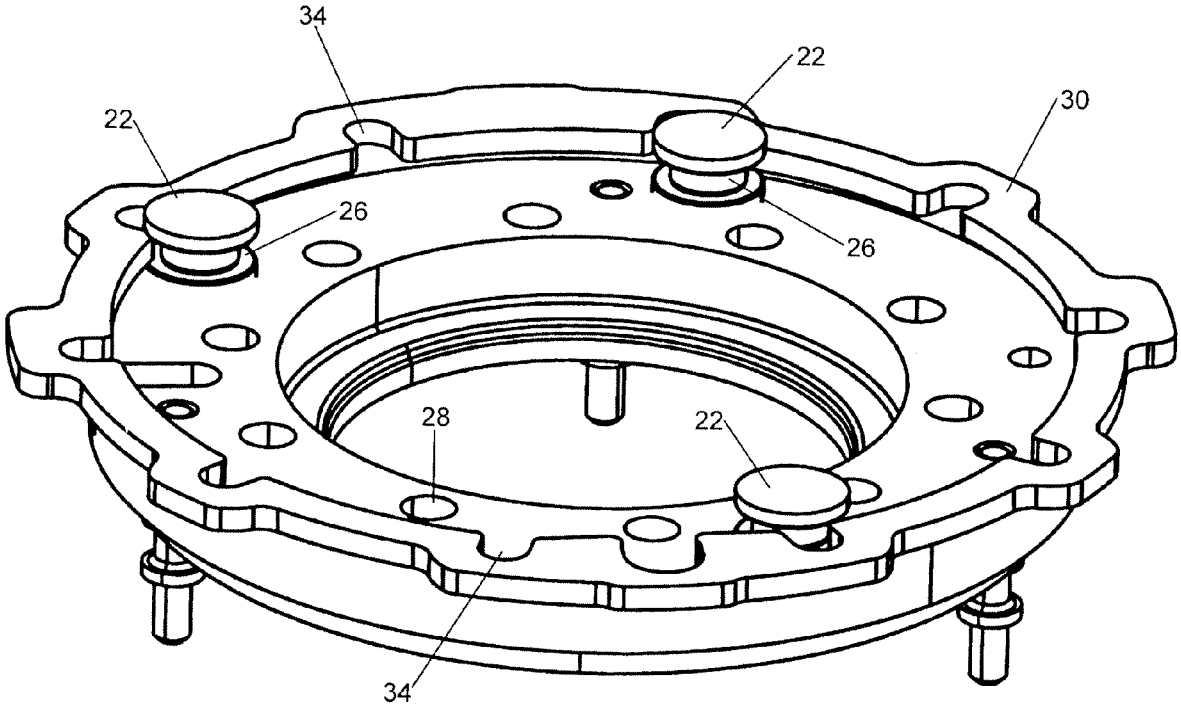
FIG. 4 is a perspective view showing the nozzle ring with the unison ring positioned such that recesses therein are aligned with the radial-axial guide pins, and moved into proximity to the nozzle ring.

In accordance with some embodiments of the invention, recesses 34 in the inner edge 32 of the unison ring are used to advantage to facilitate assembly of the unison ring with the nozzle ring and radial-axial guide pins. More particularly, the radial-axial guide pins 22 are located so that all of the pins can simultaneously be aligned with corresponding ones of the recesses 34 in the unison ring, when the unison ring is positioned in the correct rotational orientation with respect to the nozzle ring as shown in FIG. 3. The recesses 34 provide enough relief such that the unison ring can be slid axially into proximity with the first face of the nozzle ring, clearing the guide pins 22, as shown in FIG. 4.

Figure 5:
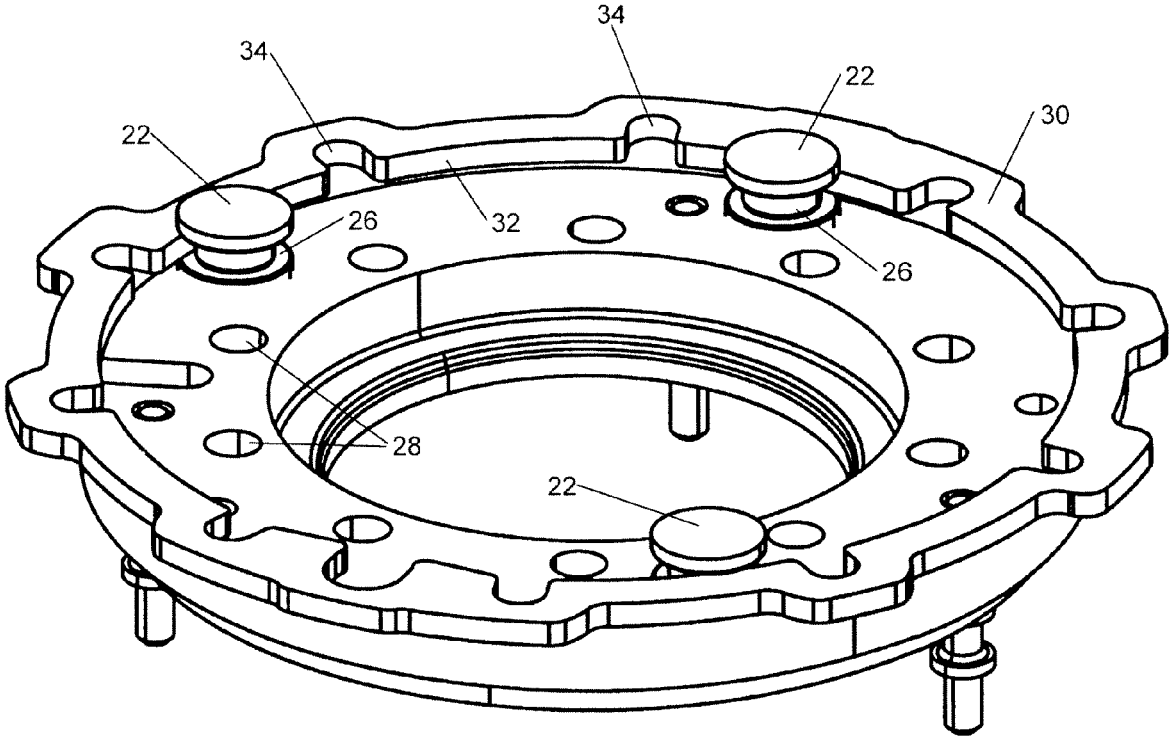
FIG. 5 is a view similar to FIG. 4, but with the unison ring rotated to a second rotational orientation such that the inner edge of the unison ring engages the grooves in the radial-axial guide pins.

Advantageously, the recesses 34 can comprise ones of the same recesses that are provided to receive the ends of vanes arms, as further described below. Alternatively, it is possible to provide dedicated recesses whose only function is to facilitate assembly. In either case, the next step in the assembly process is to rotate the unison ring 30 with respect to the nozzle ring 20 such that the inner edge 32 of the unison ring engages the grooves 26 in the radial-axial guide pins 22, as shown in FIG. 5. In this position of the unison ring, the flanges of the guide pins on opposite sides of each groove 26 restrain the unison ring against axial movement, while the bottom walls of the grooves 26 collectively restrain the unison ring against radial movement relative to the nozzle ring.

Figure 6:
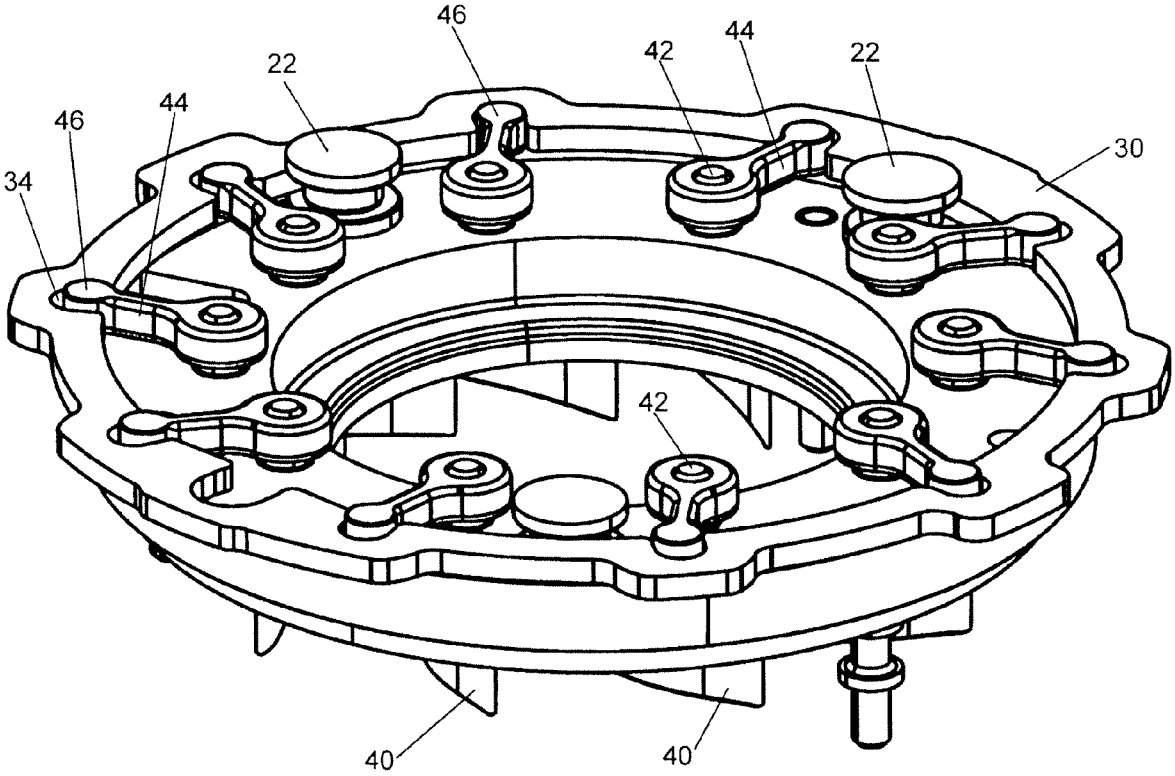
FIG. 6 is a perspective view of the variable-vane assembly after addition of the vanes, the attachment of the vane arms to the vanes, and the engagement of the ends of the vane arms in the recesses of the unison ring.

The next step in the assembly process is to assemble the vanes with the nozzle ring and unison ring. With reference to FIG. 6, each vane 40 has an axle 42 rigidly affixed thereto. The axles 42 are inserted through corresponding second apertures 28 (FIG. 3) in the nozzle ring, which apertures 28 extend entirely through the nozzle ring from the first face to an opposite second face thereof. The axles 42 are inserted into the apertures 28 from the second face, and distal ends of the axles extend slightly beyond the first face. A vane arm 44 engaged with the distal end of each vane axle 42. Each vane arm has a free end 46 that is engaged in one of the recesses 34 in the unison ring 30. The vanes 40 are positioned such that all of the vanes have the same setting angle, and then the vane arms are rigidly affixed to the axles 42, such as by welding.

The assembly as depicted in FIG. 6 thus has the unison ring 30 substantially fixed in the radial and axial directions with respect to the nozzle ring 20, while the unison ring is able to rotate about the axis of the nozzle ring in order to change the setting angles of the vanes 40.

Figure 7:
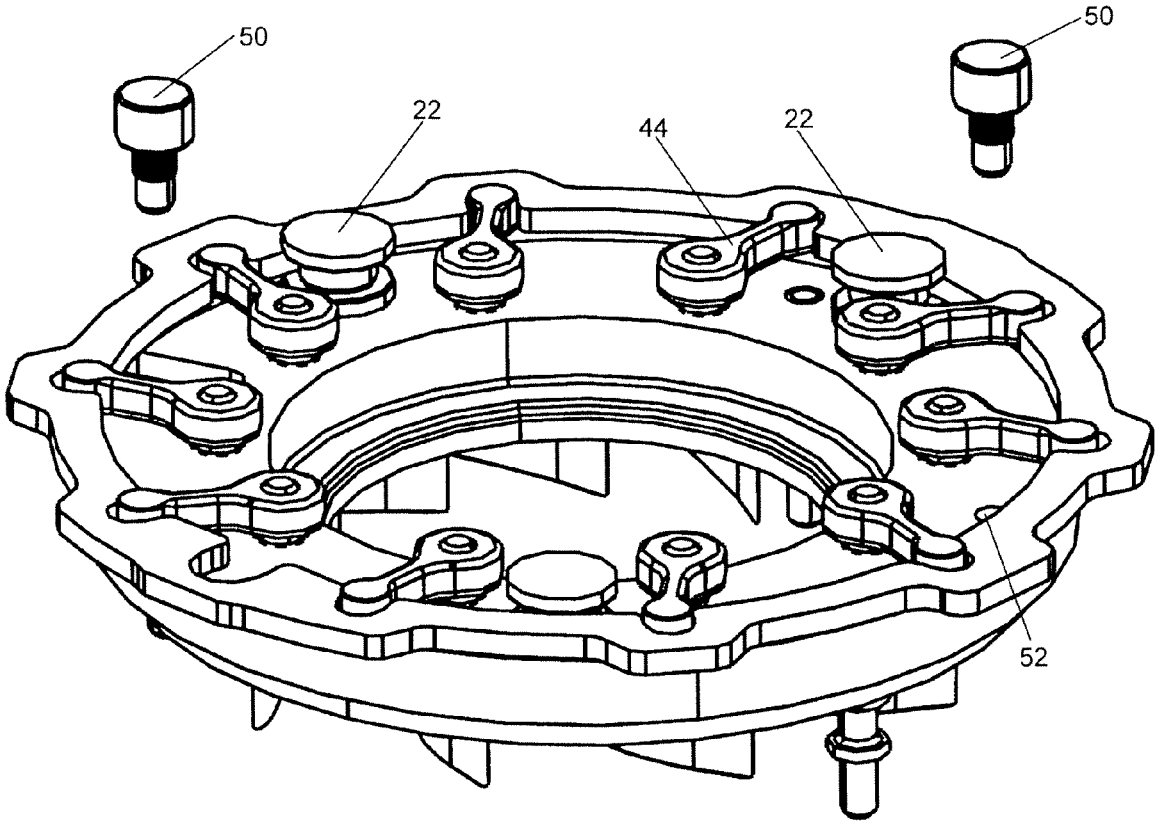
FIG. 7 is an exploded view of the assembly of FIG. 6 and the radial-only guide pins.
Figure 8:
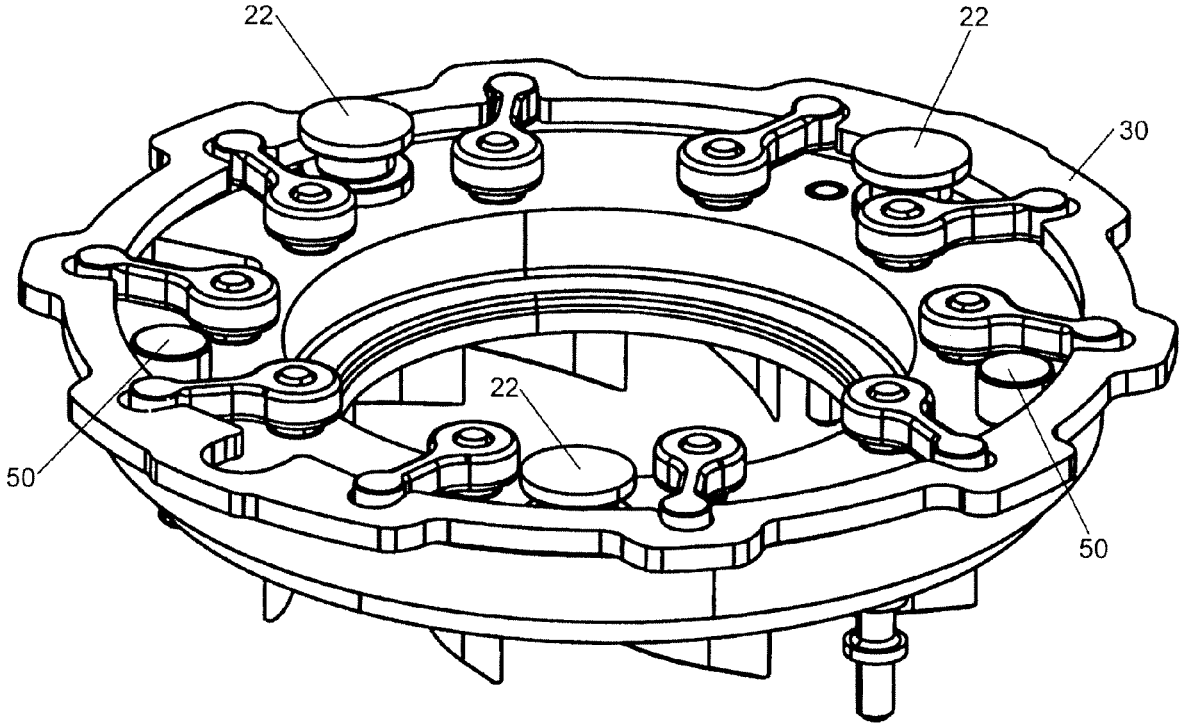
FIG. 8 shows the assembly after the radial-only guide pins have been fixedly secured in corresponding apertures in the first face of the nozzle ring.

In another embodiment as shown in FIG. 7, the assembly of FIG. 6 is modified by adding additional guide pins 50. The nozzle ring includes third apertures 52 extending into the first face of the nozzle ring, and the guide pins 50 are press-fit or otherwise rigidly secured in the third apertures. The guide pins 50 comprise radial-only guide pins, meaning that they restrain the unison ring 30 radially but not axially. Accordingly, the radial-only guide pins 50 do not include circumferential grooves as the radial-axial guide pins do. The radial-only guide pins collectively define a maximum outer diameter ideally equal to that defined by the bottom walls of the grooves in the radial-axial guide pins. Thus, the radial-axial and radial-only guide pins all cooperate to locate the unison ring radially with respect to the nozzle ring. The addition of the radial-only guide pins increases the total bearing surface area in engagement with the unison ring's inner edge. In the illustrated embodiment, there are three radial-axial guide pins and two radial-only guide pins. However, different numbers of these guide pins can be used.

Figure 9:
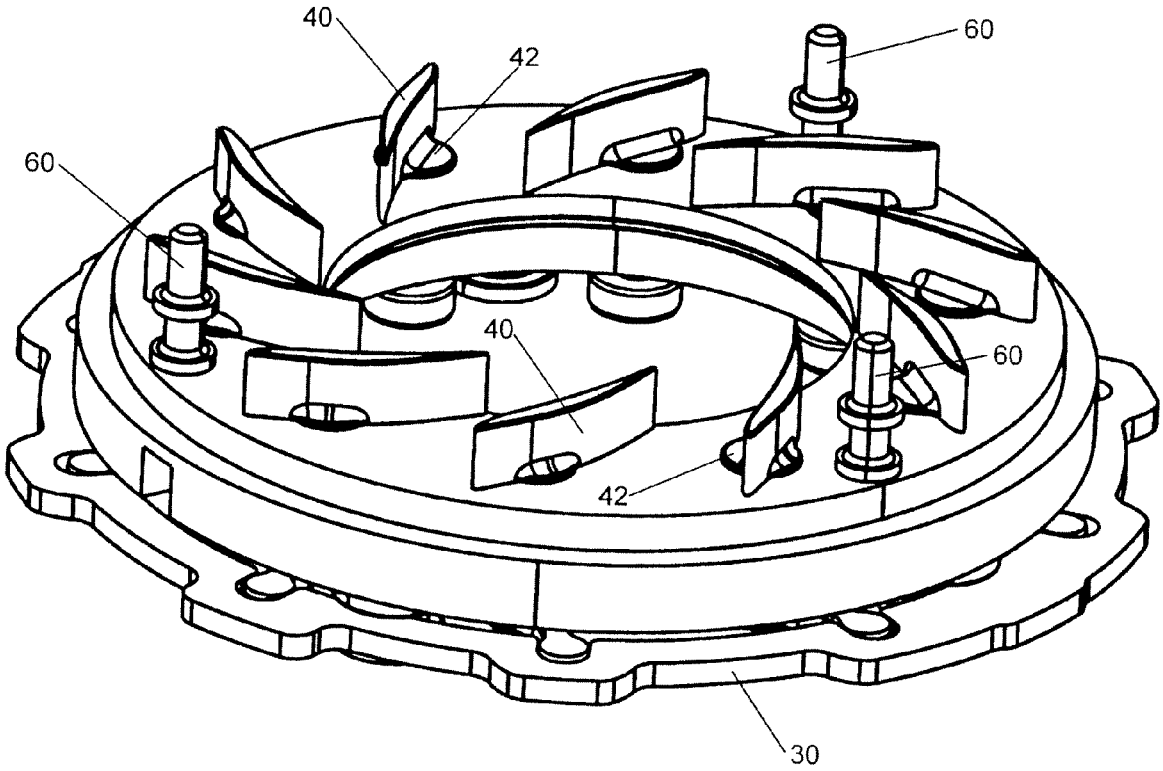
FIG. 9 is a perspective view of the assembly of FIG. 8, turned over to show the vanes adjacent the second face of the nozzle ring.
Figure 10:
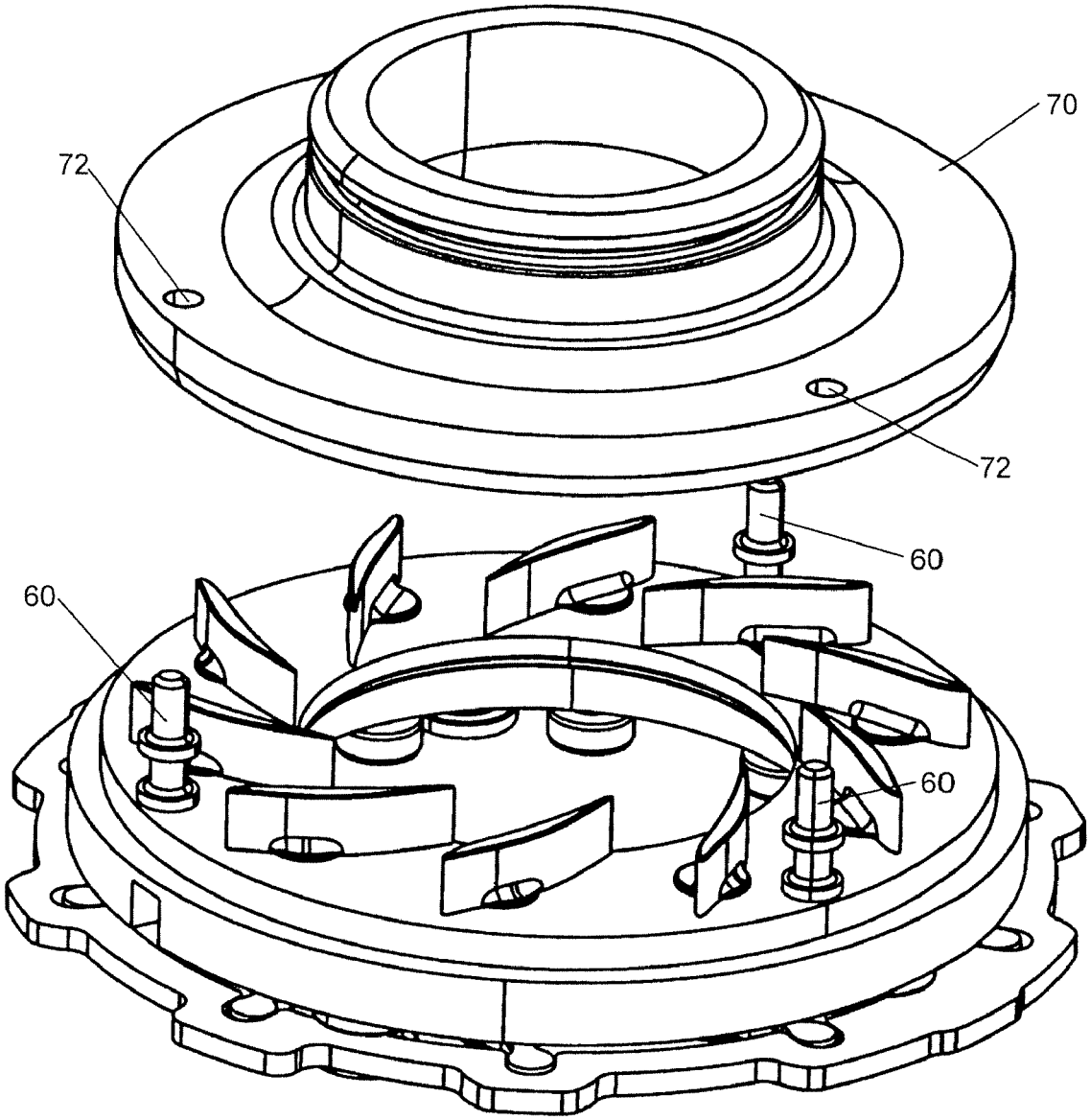
FIG. 10 is an exploded view showing the assembly of FIG. 9 and a turbine housing insert to be assembled therewith.

FIG. 9 shows the variable-vane assembly turned over relative to the orientation in FIGS. 1-8, so that the vanes 40 and their axles 42 can more readily be seen. Also visible in FIG. 9 are three spacers 60 rigidly affixed to the nozzle ring and projecting axially from the second face thereof for engagement with a turbine housing insert 70 (FIG. 10). The turbine housing insert 70 has three apertures 72 for receiving end portions of the spacers 70. The spacers have shoulders or radial bosses that abut the second face of the nozzle ring and the opposite face of the insert 70 so as to dictate the axial spacing between these faces. The spacers are rigidly affixed to the nozzle ring and insert, such as by welding. The nozzle ring and insert thus cooperate to form a passage therebetween, and the variable vanes 44 are arranged in the passage and preferably extend in the axial direction fully across the passage so that fluid flowing through the passage is constrained to flow through the spaces between the vanes.

Figure 11:
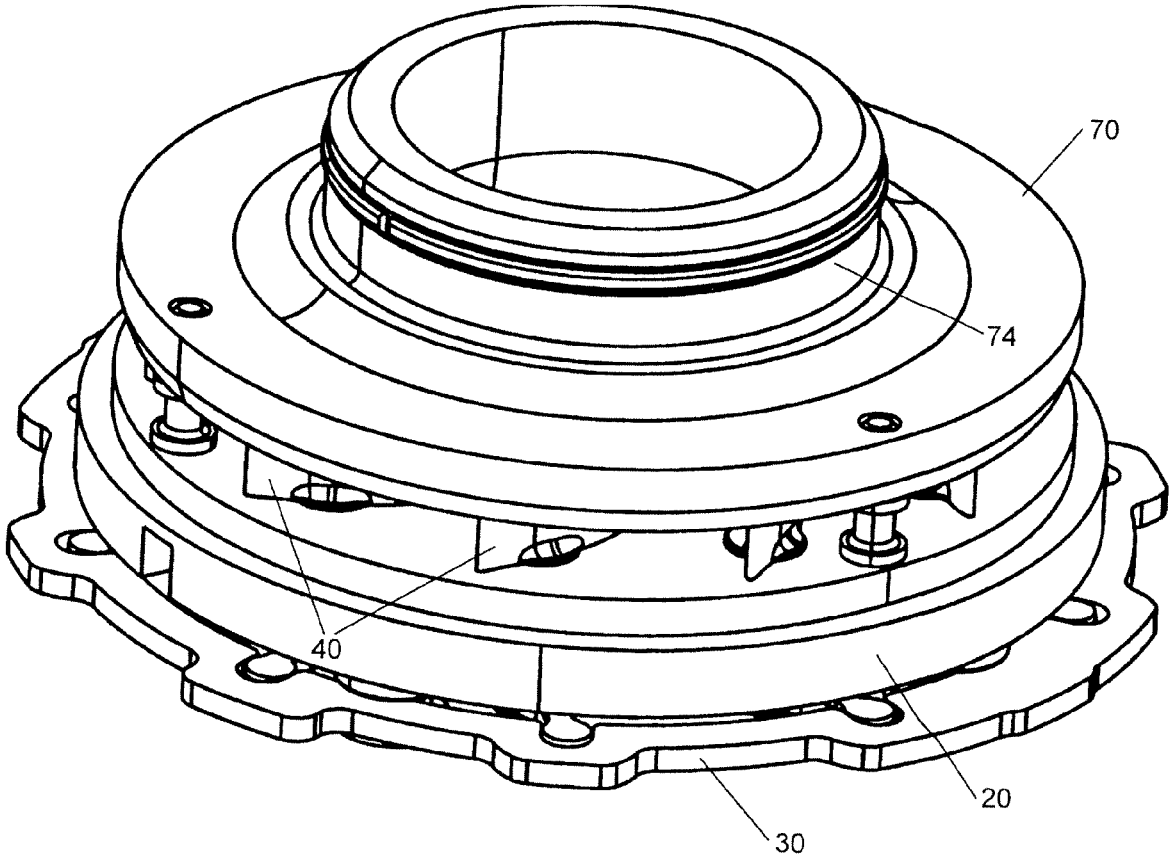
FIG. 11 shows the assembly and turbine housing insert of FIG. 10 in the assembled state.

The turbine housing insert 70 is configured with a tubular portion 74 (FIG. 11) to be inserted into the bore of a turbine housing in a turbocharger. The entire variable-vane assembly, including the turbine housing insert 70, forms a unit that is installable into the turbine housing bore. The turbine housing is then connected to a center housing of the turbocharger such that the variable-vane assembly is captured between the turbine and center housings.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A variable-vane assembly for a turbocharger, comprising:

a nozzle ring encircling an axis and having an axial thickness defined between opposite first and second faces of the nozzle ring, the nozzle ring having a plurality of circumferentially spaced-apart first apertures each extending axially into the first face and a plurality of circumferentially spaced-apart second apertures that are circumferentially spaced from the first apertures and each of which extends axially from the first face to the second face;

a plurality of vanes each having an axle extending from one end thereof, the axles being received respectively into the second apertures from the second face of the nozzle ring and being rotatable in the second apertures such that the vanes are rotatable about respective axes defined by the axles, a distal end of each axle projecting out from the respective second aperture beyond the first face;

a plurality of vane arms respectively affixed rigidly to the distal ends of the axles, each vane arm having a free end;

a unison ring having a radially inner edge defining a plurality of recesses therein for respectively receiving the free ends of the vane arms when the unison ring is positioned coaxially with the nozzle ring adjacent the first face thereof, the unison ring being rotatable about the axis of the nozzle ring so as to pivot the vane arms, thereby pivoting the vanes in unison; and a plurality of radial-axial guide pins for the unison ring, the radial-axial guide pins each being inserted into a respective one of the first apertures in the nozzle ring and being rigidly affixed therein such that the radial-axial guide pins are non-rotatably secured to the nozzle ring with a guide portion of each radial-axial guide pin projecting axially from the first face of the nozzle ring, each guide portion defining a groove in a radially outwardly facing outer surface thereof for receiving the radially inner edge of the unison ring such that the unison ring is restrained by the radial-axial guide pins against excessive movement in both radial and axial directions.

2. The variable-vane assembly of claim 1, wherein the nozzle ring defines a plurality of circumferentially spaced-apart third apertures extending into the first face and being circumferentially spaced from the first and second apertures, and further comprising:

a plurality of radial-only guide pins inserted respectively into the third apertures and rigidly affixed therein such that the radial-only guide pins are non-rotatably secured to the nozzle ring with a guide portion of each radial-only guide pin projecting axially from the first face of the nozzle ring, the guide portion of each radial-only guide pin having an outer surface contacting the radially inner edge of the unison ring such that the unison ring is restrained by the radial-only guide pins against excessive movement in the radial direction but not in the axial direction.

3. The variable-vane assembly of claim 1, wherein the radial-axial guide pins are configured and located and the recesses in the radially inner edge of the unison ring are configured and located such that in a first rotational position of the unison ring with respect to the nozzle ring each of the radial-axial guide pins is aligned with an associated one of the recesses in the inner edge of the unison ring, thereby allowing the unison ring to be slid axially past the radial-axial guide pins into proximity with the first face of the nozzle ring, the unison ring then being rotatable into a second rotational position with respect to the nozzle ring in which the radial-axial guide pins are misaligned with the recesses in the unison ring such that the unison ring is captured by the radial-axial guide pins and prevented from being axially withdrawn from the nozzle ring.

4. The variable-vane assembly of claim 3, wherein the nozzle ring defines a plurality of circumferentially spaced-apart third apertures extending into the first face and being circumferentially spaced from the first and second apertures, and further comprising:

a plurality of radial-only guide pins inserted respectively into the third apertures and rigidly affixed therein such that the radial-only guide pins are non-rotatably secured to the nozzle ring with a guide portion of each radial-only guide pin projecting axially from the first face of the nozzle ring, the guide portion of each radial-only guide pin having an outer surface contacting the radially inner edge of the unison ring such that the unison ring is restrained by the radial-only guide pins against excessive movement in the radial direction but not in the axial direction.

5. A method for assembling a variable-vane assembly for a turbocharger, comprising the steps of:

rigidly securing a plurality of radial-axial guide pins respectively in a corresponding plurality of first apertures in a first face of a nozzle ring such that the radial-axial guide pins are non-rotatably secured to the nozzle ring, each radial-axial guide pin having a guide portion projecting axially from the first face, each guide portion defining a groove in a radially outwardly facing outer surface, the radial-axial guide pins being circumferentially spaced about the nozzle ring;

providing a unison ring having a radially inner edge in which a plurality of circumferentially spaced recesses are defined and arranged such that the unison ring can be positioned in a first rotational orientation with respect to the nozzle ring in which each radial-axial guide pin is aligned with one of the recesses;

axially sliding the unison ring in said first rotational orientation toward the first face of the nozzle ring such that the guide portions of the radial-axial guide pins are received by the recesses in the unison ring;

rotating the unison ring from the first rotational orientation to a second rotational orientation with respect to the nozzle ring such that the inner edge of the unison ring engages the grooves in the radial-axial guide pins, the unison ring thereby being restrained by the radial-axial guide pins against excessive movement with respect to the nozzle ring in both radial and axial directions;

inserting axles of a plurality of vanes respectively into a corresponding plurality of circumferentially spaced second apertures in a second face of the nozzle ring opposite from said first face, distal ends of the axles projecting axially out from the first face; and rigidly securing a plurality of vane arms respectively to the distal ends of the axles, each vane arm having a free end, the free ends of the vane arms being respectively engaged in the recesses in the inner edge of the unison ring, whereby rotation of the unison ring causes the vanes to pivot in unison.

* * * * *